US009267273B2

(12) United States Patent
Chen

(10) Patent No.: US 9,267,273 B2
(45) Date of Patent: Feb. 23, 2016

(54) METHOD AND DEVICE FOR INCORPORATING WALL-MOUNT FAUCETS TO MODULAR/FURNITURE BATH SINK VANITIES

(71) Applicant: James Pey Chen, Cary, IL (US)

(72) Inventor: James Pey Chen, Cary, IL (US)

( * ) Notice: Subject to any disclaimer, the term of this patent is extended or adjusted under 35 U.S.C. 154(b) by 173 days.

(21) Appl. No.: 13/949,152

(22) Filed: Jul. 23, 2013

(65) Prior Publication Data

US 2014/0026387 A1 Jan. 30, 2014

Related U.S. Application Data

(60) Provisional application No. 61/676,320, filed on Jul. 26, 2012.

(51) Int. Cl.
*E03C 1/181* (2006.01)
*E03C 1/02* (2006.01)

(52) U.S. Cl.
CPC ..... *E03C 1/181* (2013.01); *E03C 1/021* (2013.01); *Y10T 29/4943* (2015.01); *Y10T 29/49826* (2015.01); *Y10T 29/49895* (2015.01); *Y10T 29/49899* (2015.01); *Y10T 29/49901* (2015.01); *Y10T 29/49947* (2015.01); *Y10T 29/53843* (2015.01)

(58) Field of Classification Search
CPC ... E03C 1/181; E03C 1/021; Y10T 29/49826; Y10T 29/49895; Y10T 29/49899; Y10T 29/49901; Y10T 29/49947; Y10T 29/53843; Y10T 29/48428; Y10T 29/4943
See application file for complete search history.

(56) References Cited

U.S. PATENT DOCUMENTS

| | | | | |
|---|---|---|---|---|
| 5,855,029 | A * | 1/1999 | Flippen, Sr. | 4/664 |
| 8,789,555 | B2 * | 7/2014 | Ball et al. | 137/359 |
| 2010/0101018 | A1 * | 4/2010 | Chase et al. | 4/653 |

* cited by examiner

*Primary Examiner* — John C Hong
(74) *Attorney, Agent, or Firm* — Richards Patent Law P.C.

(57) ABSTRACT

A method and apparatus brings the wall-mount faucet installation outside of the wall to the bath vanity cabinet itself. Therefore, the plumbing is not confined by the wall stud location and distances, yielding all plumbing to be within the furniture sink vanity cabinet. The methods and apparatus enable the installation and future maintenance of wall-mount faucets to be at a minimum effort. The methods and apparatus can substantially reduce the cost of bathroom re-modeling while enabling modular/furniture/prefabricated styles of bath sink vanities to be used with wall-mount faucets.

15 Claims, 4 Drawing Sheets

METHOD AND DEVICE FOR INCORPORATING WALL-MOUNT FAUCETS TO MODULAR/FURNITURE BATH SINK VANITIES

CROSS-REFERENCE TO RELATED APPLICATION

This application claims the benefit of priority of U.S. provisional application No. 61/676,320, filed Jul. 26, 2012, the contents of which are herein incorporated by reference.

BACKGROUND OF THE INVENTION

The present invention relates to faucet mounts and, more particularly, to a method and device for incorporating wall-mount faucets to modular/furniture bath sink vanities.

Wall-mount faucets are very difficult to install. Not only does the wall need to be cut out, plumbing needs to be installed between the studs. This eliminates the potential to be able to use a furniture style vanity cabinet.

Therefore, custom cabinetry is needed to use wall-mount faucets, which further increases the expenditure. The effort with the installation and the extra spending on the faucet and custom vanity prevents this type of wall-mount faucets from becoming more popular than it is today.

Current wall-mount faucet installation locations are limited to the locations and distances of the wall studs. With a double vanity, this problem is compounded, as both wall-mount faucets need to line up not only with the vanity sinks, but also with adequate space between the wall studs.

As can be seen, there is a need for an improved apparatus and method for installing wall-mount faucets in modular/furniture/prefabricated bath sink vanities.

SUMMARY OF THE INVENTION

In one aspect of the present invention, a method for mounting a wall-mount faucet on a furniture/modular/prefabricated bath sink vanity comprises extending fixture feed lines into a cavity of a back splash case disposed atop a vanity, the fixture feed lines extending into the cavity through holes in the back splash case; and mounting a fixture inside the cavity with knobs and a faucet stem accessible from a front face of the back splash case.

In another aspect of the present invention, a method for mounting a wall-mount faucet on a furniture/modular/prefabricated bath sink vanity comprises extending fixture feed lines into a cavity of a back splash case disposed atop a vanity, the fixture feed lines extending into the cavity through holes in the back splash case; mounting a fixture inside the cavity with knobs and a faucet stem accessible from a front face of the back splash case; attaching upper and lower spacer blocks to a fixture protrusion disposed within the cavity; and mounting a fixture plate to the spacer blocks.

In a further aspect of the present invention, a back splash case comprises a cavity accessible from a back side of the back splash case; a plurality of case fixture holes communicating the cavity with a front side of the back splash case; a fixture protrusion disposed about the plurality of case fixture holes; a plurality of spacer block fitting holes disposed in the fixture protrusion for mounting spacer blocks; and plumbing holes disposed in a bottom side of the back splash case, the plumbing holes permitting fixture feed lines to extend into the cavity.

These and other features, aspects and advantages of the present invention will become better understood with reference to the following drawings, description and claims.

DETAILED DESCRIPTION OF THE INVENTION

Figure 1:
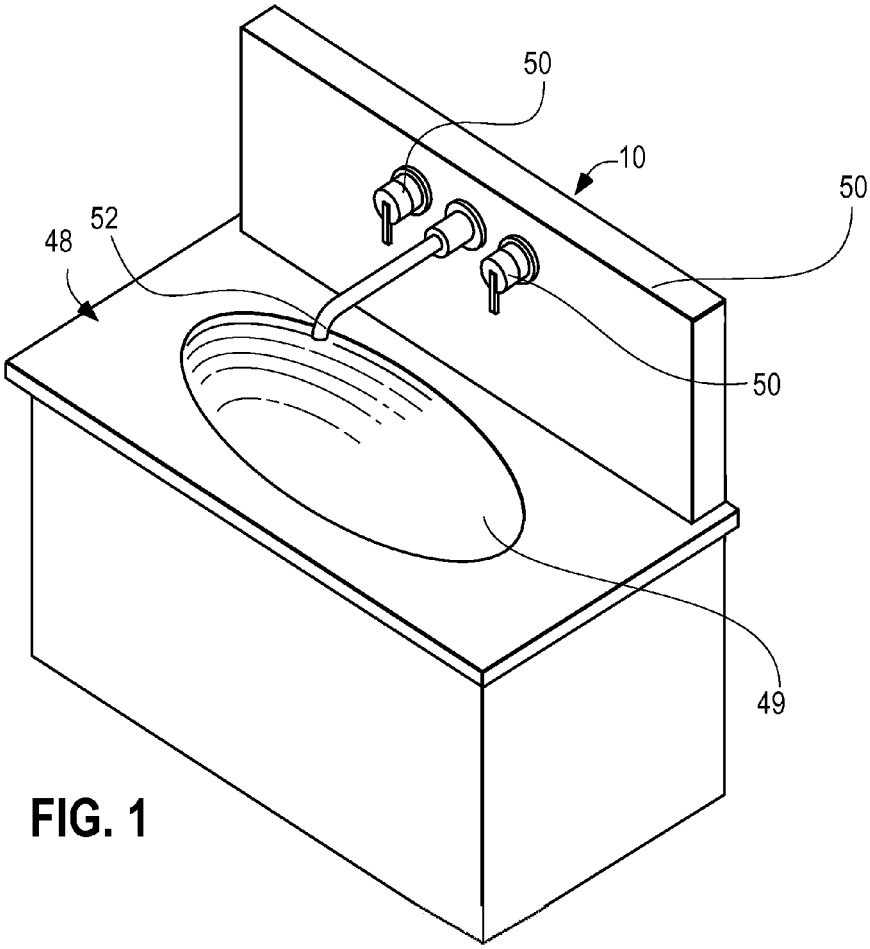
FIG. 1 is a perspective view of a back splash case installed on a vanity for mounting a wall-mount faucet according to an exemplary embodiment of the present invention.
Figure 2:
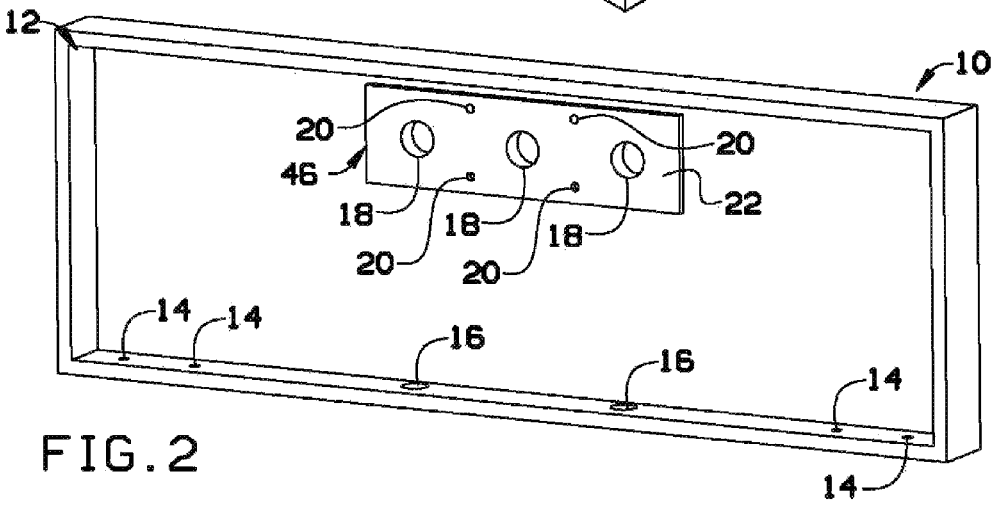
FIG. 2 is a back perspective view of the back splash case of FIG. 1.
Figure 3:
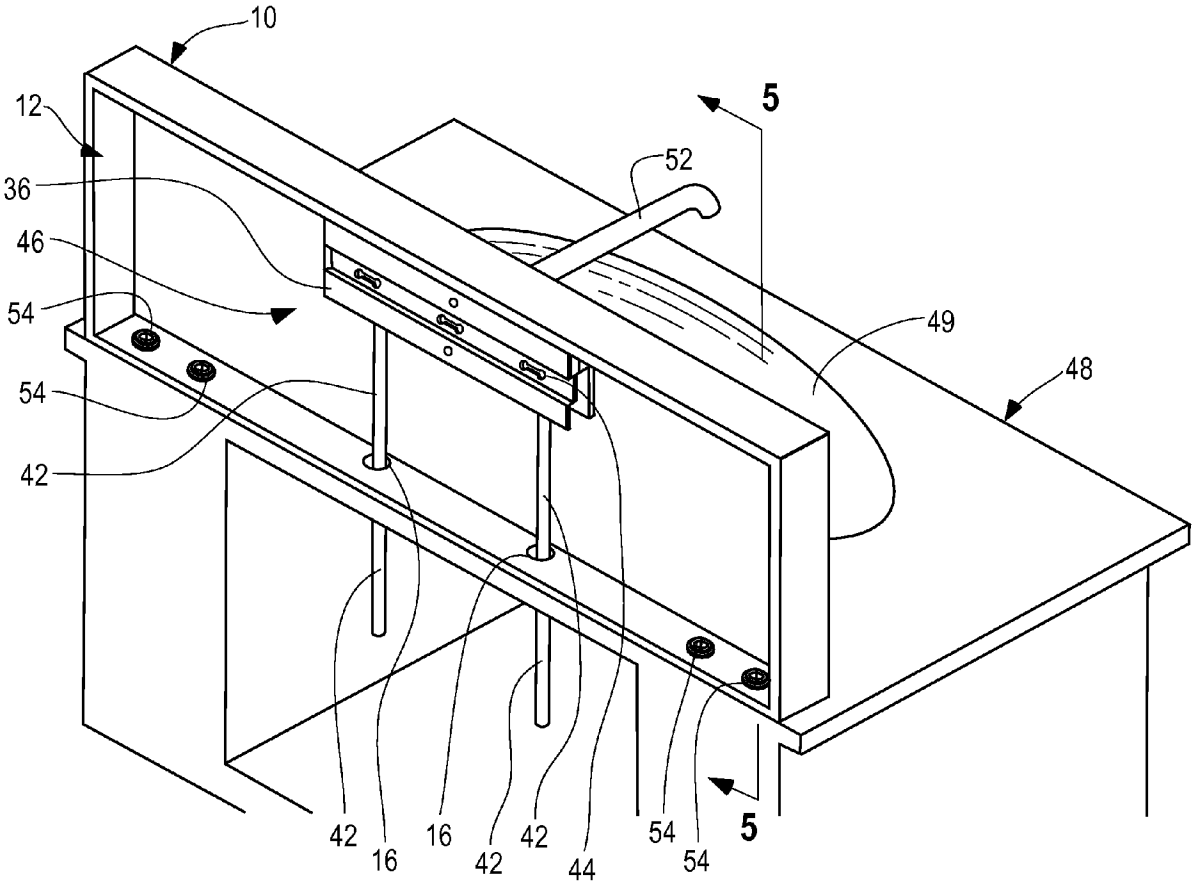
FIG. 3 is a back perspective view of the back splash case and vanity cabinet of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a method and apparatus for bringing the wall-mount faucet installation outside of the wall to the bath vanity cabinet itself. Therefore, the plumbing is not confined by the wall stud location and distances, yielding all plumbing to be within the furniture sink vanity cabinet. The methods and apparatus of the present invention enable the installation and future maintenance of wall-mount faucets to be at a minimum effort. The methods and apparatus of the present invention can substantially reduce the cost of bathroom re-modeling. The methods and apparatus of the present invention also enable modular/furniture/prefabricated styles of bath sink vanities to be used with wall-mount faucets.

Referring now to FIGS. 1 through 5, a back splash case 10 is offset from the back wall with an adequate cavity 12 inside to allow all the plumbing parts to be installed and hidden. The back splash case 10 can include a plurality of fixture holes 18 adapted for mounting a fixture 46 thereto. A fixture protrusion 22 can be disposed within the cavity 12, surrounding the fixture holes 18. The fixture protrusion 22 can include mounting holes 20 for mounting optional spacers, as discussed in greater detail below.

Figure 4:
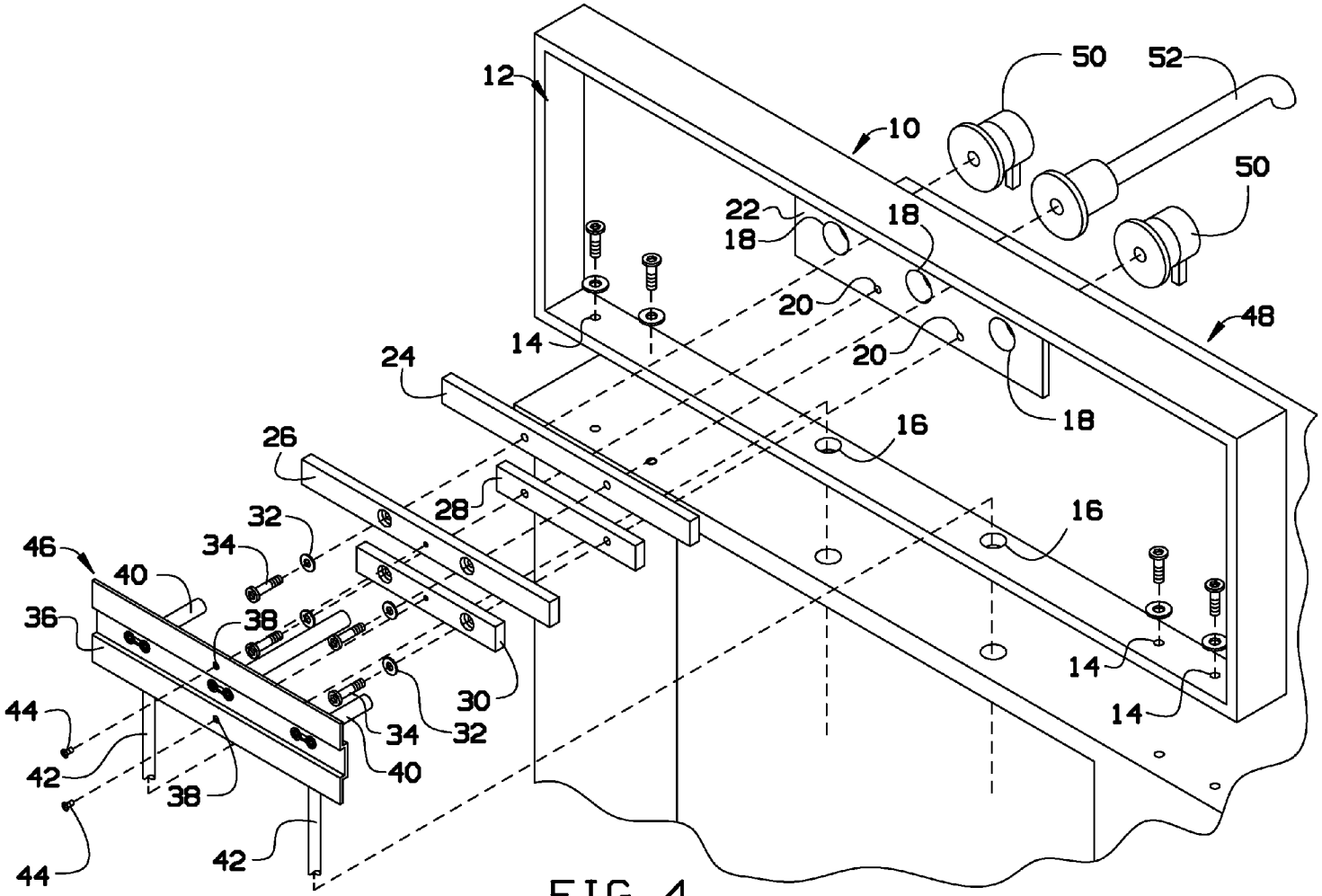
FIG. 4 is an exploded perspective view of the back splash case and vanity cabinet of FIG. 1.
Figure 5:
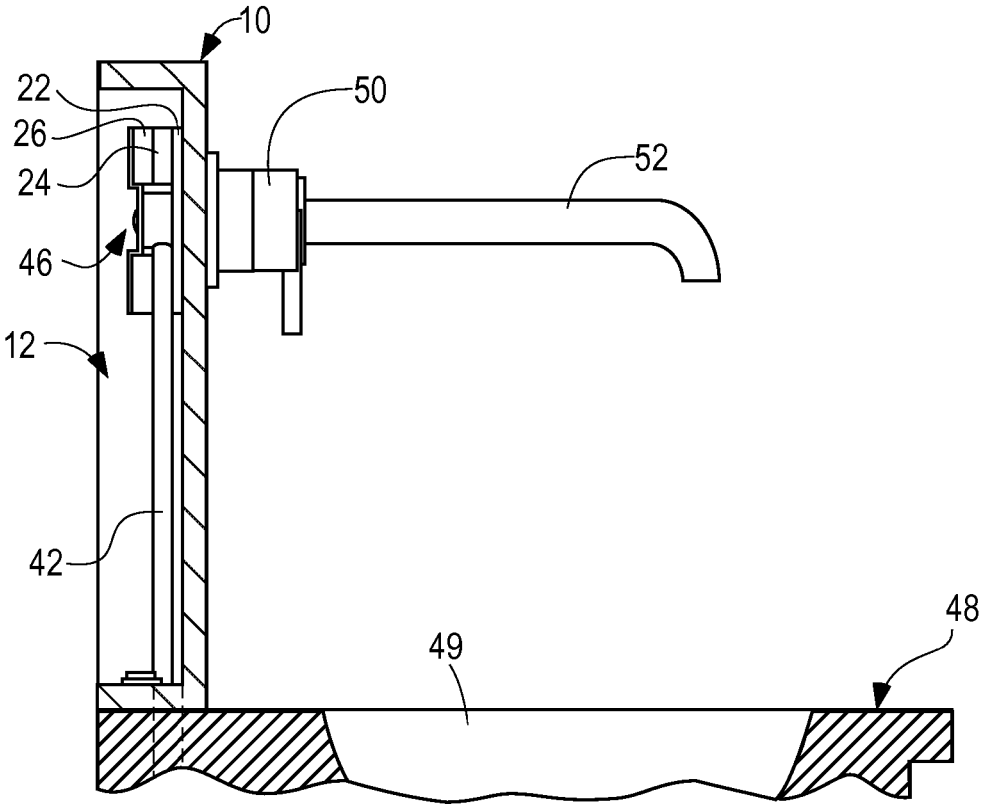
FIG. 5 is a cross-sectional view taken along line 5-5 of FIG. 3.

In some embodiments, the back splash case 10 can be formed integrally with a vanity top 48 including a sink 49. In other embodiments, as shown in FIGS. 1, 4 and 5, for example, the back splash case 10 can be affixed to the vanity (or cabinet) top 48 and sink 49 with securement screws 54 disposed through securement holes 14 formed along a bottom portion of the back splash case 10. In either embodiment, the back splash case 10 can include case piping holes 16 for permitting fixture feed lines 42 to pass into the cavity 12 and attach to the fixture 46.

Upper and lower spacer blocks can be attached to the fixture protrusion 22. In some embodiments, as shown in FIG. 4, an upper spacer block with through holes 24 can be disposed against the fixture protrusion 22 and an upper spacer block with counterbore holes 26 can be placed atop the upper spacer block with through holes 24. A spacer block bolt 34 and washer 32 can secure blot upper spacer blocks 24, 26 to the fixture protrusion 22. The upper spacer block with counterbore holes 26 allows the head of the spacer block bolt 34 to sit flush or within the spacer block 26, allowing a fixture plate 36 to be secured thereto. Similarly, a lower spacer block with through holes 28 and a lower spacer block with counterbore holes 30 can be attached to the fixture protrusion 22 with spacer block bolts 34. Typically, the lower spacer blocks 28, 30 are shorter than the upper spacer blocks 24, 26 in order to allow the fixture feed lines 42 to attach to the fixture 46.

In some embodiments, instead of two upper spacer blocks 24, 26 and two lower spacer blocks 28, 30, a single upper and lower spacer block (not shown) with a counterbore hole and a through hole extending from the counterbore hole can be used. In other embodiments, the spacer blocks can attach to the fixture protrusion 22 by a mechanism other than screws, such as locking tabs, keyhole slots, or the like.

In some embodiments, the spacer blocks can be integral with the back splash case 10. In this embodiment, a through hole and counterbore hole would not be necessary. Typically, with integral spacer blocks, the back splash case would be designed for specific brands of fixtures or for fixtures with certain specifications.

The fixture plate 36 can include fixture plate securement holes 38 formed therein for attaching the fixture plate 36 to the spacer blocks. Fixture plate securement screws 44 can affix the fixture plate 36 to the spacer blocks.

To use the present invention, a user can connect the back splash case 10 to the vanity/cabinet top 48, align the opening for plumbing at the bottom of the case opening and the top of the base cabinet. Since there is no standard template for the wall mount of a wall-mount faucet, locations can be found where it is appropriate to install the spacing block onto the fixture protrusion 22. The wall-mount faucet fixture 46 can then be positioned so the valve stems 40 and spigot can come out of the fixture holes 18. The fixture plate 36 can then be affixed to the spacer blocks. The flow control knobs 50 and the faucet stem 52 can be attached to the fixture 46 as is known in the art and positioned adjacent to the sink 49 in the vanity 48 as shown in FIG. 1.

In some embodiments, such as with deck mount fixtures, the spacer blocks may not be needed. In these embodiments, the fixture can simply attach through the fixture holes 18 onto the fixture protrusion 22.

While the Figures show the cavity 12 being open along the entire back splash case 10, the cavity 12 may be open only along a portion of the back splash case 10, provided that there is room to affix the fixture 46 within the cavity 12.

The back splash case 10 can be made from various materials, including wood, concrete, composite, engineered solid surface materials (such as Corian®, acrylic, or the like), natural solid surface materials (such as quartz, granite, or the like), or the like. The front of the back splash case 10 can form the back splash itself, or can serve as a substrate for additional material to be added to form the back splash.

It should be understood, of course, that the foregoing relates to exemplary embodiments of the invention and that modifications may be made without departing from the spirit and scope of the invention as set forth in the following claims.

What is claimed is:

1. A method for mounting a wall-mount faucet on a bath sink vanity, comprising:

extending fixture feed lines into a cavity of a back splash case disposed atop a vanity including a sink, the fixture feed lines extending into the cavity through holes in the back splash case;

mounting a fixture inside the cavity with knobs and a faucet stem accessible from a front face of the back splash case;

mounting a fixture plate to the fixture inside the cavity; and positioning the knobs and faucet stem adjacent to the sink in the vanity.

2. The method of claim 1, further comprising attaching the back splash case to the vanity.

3. The method of claim 2, further comprising aligning holes in a bottom portion of the back splash case with holes in the vanity for passing the fixture feed lines therethrough.

4. The method of claim 1, wherein the back splash case is made integral with the vanity.

5. The method of claim 1, further comprising:

attaching spacer blocks to a fixture protrusion disposed within the cavity; and mounting the fixture plate to the spacer blocks.

6. The method of claim 1, further comprising mounting the fixture plate of the fixture to integral spacer blocks disposed within the cavity.

7. A method for mounting a wall-mount faucet on a bath sink vanity, comprising:

extending fixture feed lines into a cavity of a back splash case disposed atop a vanity including a sink, the fixture feed lines extending into the cavity through holes in the back splash case;

mounting a fixture inside the cavity with knobs and a faucet stem accessible from a front face of the back splash case;

attaching upper and lower spacer blocks to a fixture protrusion disposed within the cavity;

mounting a fixture plate to the spacer blocks; and positioning the knobs and faucet stem adjacent to the sink in the vanity.

8. The method of claim 7, further comprising attaching the upper and lower spacer blocks with spacer block bolts disposed in counterbore holes formed in a face of the upper and lower spacer blocks.

9. The method of claim 7, further comprising:

attaching the back splash case to the vanity; and aligning holes in a bottom portion of the back splash case with holes in the vanity for passing the fixture feed lines therethrough.

10. The method of claim 7, wherein the back splash case is made integral with the vanity.

11. A back splash case comprising:

a cavity accessible from a back side of the back splash case;

a plurality of case fixture holes communicating the cavity with a front side of the back splash case;

a fixture protrusion disposed about the plurality of case fixture holes within the cavity;

a spacer block disposed against the fixture protrusion adapted to receive fixture feed lines;

a plurality of spacer block fitting holes disposed in the fixture protrusion for mounting the spacer block; and plumbing holes disposed in a bottom side of the back splash case, the plumbing holes permitting the fixture feed lines to extend into the cavity.

12. The back splash case of claim 11, wherein the spacer block includes a counterbore hole and a through hole extending from the counterbore hole.

13. The back splash case of claim 11, wherein the spacer block comprises an upper spacer block having a first length and a lower spacer block having a second length less than the first length.

14. The back splash case of claim 11, wherein the spacer block is configured to receive a fixture plate.

15. The back splash case of claim 11, wherein the spacer block is integral with the back splash case.

* * * * *